US012742459B2

(12) United States Patent
Shi et al.

(10) Patent No.: US 12,742,459 B2
(45) Date of Patent: Sep. 22, 2026

(54) COMPRESSOR SHROUD WITH SWEPT GROOVES

(71) Applicant: PRATT & WHITNEY CANADA CORP., Longueuil (CA)

(72) Inventors: Feng Shi, Mississauga (CA); Jason Nichols, Mississauga (CA); Hong Yu, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 13 days.

(21) Appl. No.: 19/061,187

(22) Filed: Feb. 24, 2025

(65) Prior Publication Data

US 2025/0188950 A1 Jun. 12, 2025

Related U.S. Application Data

(63) Continuation of application No. 17/528,323, filed on Nov. 17, 2021, now abandoned.

(51) Int. Cl.
*F01D 11/08* (2006.01)
*F04D 19/02* (2006.01)
(Continued)

(52) U.S. Cl.
CPC ..... *F04D 29/541* (2013.01); *F01D 11/08* (2013.01); *F04D 19/02* (2013.01); *F04D 29/526* (2013.01); *F04D 29/681* (2013.01); *F04D 29/685* (2013.01)

(58) Field of Classification Search
CPC .... F04D 29/526; F04D 29/685; F04D 29/681; F01D 11/08
See application file for complete search history.

(56) References Cited

U.S. PATENT DOCUMENTS 4,238,170 A 12/1980 Robideau
4,239,452 A * 12/1980 Roberts, Jr. ..... F01D 11/12 415/173.5
(Continued)

FOREIGN PATENT DOCUMENTS

WO 1995034745 A1 12/1995
WO WO-9534745 A1 * 12/1995 ..... B22C 7/02

*Primary Examiner* — Courtney D Heinle
*Assistant Examiner* — Behnoush Haghighian
(74) *Attorney, Agent, or Firm* — NORTON ROSE FULBRIGHT CANADA

(57) ABSTRACT

A compressor for an aircraft engine. A rotor includes blades rotatable about an axis. Blade tips extend between leading and trailing edges. A shroud surrounds the rotor, with an inner surface surrounding the tips. Grooves are defined in the shroud inner surface adjacent the tips. The grooves extend circumferentially about the shroud and radially from inlet openings to closed end surfaces. Groove sidewalls extend circumferentially about the axis. The grooves are axially spaced-apart, the most upstream inlet opening having an upstream end disposed upstream of the leading edges of the blades. The grooves have a swept angle from the inner surface, with a center of the inlet openings is axially offset of a center of the closed-end surfaces. The grooves span an overall axial distance corresponding to 30% or more of the blades' chord length. The grooves have circumferential interruptions defined by baffles, and extend non-continuously around a shroud circumference.

20 Claims, 10 Drawing Sheets

(51) Int. Cl.

| | |
|---|---|
| ***F04D 29/52*** | (2006.01) |
| ***F04D 29/54*** | (2006.01) |
| *F04D 29/68* | (2006.01) |

(56) References Cited

U.S. PATENT DOCUMENTS 4,466,772 A * 8/1984 Okapuu ..... F01D 11/08 415/173.5
4,738,586 A 4/1988 Harter
5,137,419 A * 8/1992 Waterman ..... F04D 29/685 415/914
5,203,162 A 4/1993 Burge
5,282,718 A 2/1994 Koff
5,308,225 A 5/1994 Koff
5,403,158 A 4/1995 Auxier
5,431,533 A 7/1995 Hobbs
5,474,417 A 12/1995 Privett
5,586,859 A 12/1996 Nolcheff
5,607,284 A 3/1997 Byrne
5,707,206 A * 1/1998 Goto ..... F04D 29/4213 415/173.1
5,950,308 A 9/1999 Koff
6,125,626 A 10/2000 El-Aini
6,155,778 A * 12/2000 Lee ..... F01D 11/08 415/173.1
6,227,794 B1 5/2001 Wojtyczka
6,234,747 B1 * 5/2001 Mielke ..... F01D 11/08 415/173.1
6,379,110 B1 4/2002 McCormick
6,409,469 B1 6/2002 Tse
6,585,479 B2 7/2003 Torrance
6,619,909 B2 9/2003 Barnett
6,830,428 B2 * 12/2004 Le Biez ..... F01D 11/122 415/174.4
7,147,426 B2 12/2006 LeBlanc
7,210,905 B2 * 5/2007 Lapworth ..... F04D 29/526 415/220
7,766,614 B2 * 8/2010 Northfield ..... F04D 29/685 415/196
7,861,823 B2 * 1/2011 Prasad ..... F02C 7/045 181/221
8,177,494 B2 5/2012 Ward
8,251,648 B2 * 8/2012 Johann ..... F04D 29/321 415/173.1
8,337,146 B2 12/2012 Yu
8,419,355 B2 * 4/2013 Guemmer ..... F04D 29/685 415/173.1
8,550,768 B2 * 10/2013 Montgomery ..... F04D 29/685 415/57.1
8,777,558 B2 * 7/2014 Brunet ..... F04D 29/164 415/173.1
8,845,269 B2 * 9/2014 Agneray ..... F04D 27/0207 415/220
8,915,699 B2 * 12/2014 Brignole ..... F04D 29/526 415/914
8,939,705 B1 * 1/2015 Lee ..... F01D 11/08 415/173.1
8,939,706 B1 * 1/2015 Lee ..... F01D 9/041 415/173.1
8,939,707 B1 * 1/2015 Lee ..... F01D 11/12 415/173.1
9,004,859 B2 * 4/2015 Shahpar ..... F01D 25/24 415/220
9,151,175 B2 * 10/2015 Tham ..... F01D 5/187
9,243,511 B2 * 1/2016 Lee ..... F01D 25/24
9,631,506 B2 * 4/2017 Lee ..... F01D 11/12
9,726,084 B2 8/2017 Duong
9,810,157 B2 11/2017 Nichols
9,920,646 B2 * 3/2018 Lee ..... F01D 11/122
10,066,640 B2 * 9/2018 Bennington ..... F04D 29/321
10,107,307 B2 10/2018 Urac
10,189,082 B2 * 1/2019 Tham ..... B32B 15/14
10,190,435 B2 * 1/2019 Lee ..... F01D 11/122
10,240,471 B2 3/2019 Alvanos
10,309,243 B2 * 6/2019 McCaffrey ..... F01D 9/02
10,378,554 B2 8/2019 Yu
10,465,539 B2 11/2019 Duong
10,465,716 B2 * 11/2019 Vo ..... F04D 29/526
10,487,847 B2 11/2019 Veitch
10,648,484 B2 * 5/2020 Gentry ..... F01D 5/20
10,690,146 B2 6/2020 Urac
10,718,352 B2 * 7/2020 Alban ..... F01D 11/127
10,724,403 B2 7/2020 Costa
10,724,540 B2 7/2020 Li
10,808,539 B2 10/2020 Narrow
10,830,082 B2 * 11/2020 Subramaniyan ..... F01D 11/08
10,837,361 B2 11/2020 Abrari
10,876,423 B2 * 12/2020 Reynolds ..... F04D 29/526
11,015,465 B2 * 5/2021 Reynolds ..... F01D 9/04
11,078,805 B2 8/2021 Joly
11,098,731 B2 * 8/2021 Gentry ..... F01D 5/20
11,118,601 B2 9/2021 Yu
11,136,895 B2 10/2021 Kalitzin
11,215,070 B2 1/2022 Urac
11,346,367 B2 5/2022 Yu
12,071,959 B1 8/2024 Duong
2005/0111968 A1 * 5/2005 Lapworth ..... F04D 27/0207 415/182.1
2007/0102234 A1 5/2007 Prasad et al.
2007/0147989 A1 * 6/2007 Collins ..... F01D 11/02 415/173.1
2008/0044273 A1 * 2/2008 Khalid ..... F04D 29/526 415/57.4
2009/0041576 A1 * 2/2009 Guemmer ..... F04D 29/685 415/149.4
2009/0246007 A1 * 10/2009 Johann ..... F01D 11/001 415/182.1
2010/0310353 A1 12/2010 Yu
2010/0329852 A1 * 12/2010 Brignole ..... F04D 29/164 415/220
2011/0085896 A1 * 4/2011 Brunet ..... F04D 29/164 415/182.1
2011/0299979 A1 * 12/2011 Montgomery ..... F04D 29/526 415/182.1
2012/0003085 A1 * 1/2012 Agneray ..... F04D 29/547 415/199.5
2016/0040546 A1 * 2/2016 Vo ..... F04D 29/685 415/173.1
2016/0153465 A1 * 6/2016 Yoon ..... F04D 29/522 415/173.1
2016/0230776 A1 * 8/2016 Bennington ..... F04D 29/685
2017/0051614 A1 * 2/2017 Merrill, Jr. ..... F01D 5/288
2017/0051626 A1 * 2/2017 Lee ..... F01D 11/12
2017/0175560 A1 * 6/2017 Merrill ..... F01D 5/187
2017/0370241 A1 * 12/2017 Tham ..... B22C 9/24
2018/0171871 A1 6/2018 Duong
2018/0231023 A1 * 8/2018 Gentry ..... F01D 5/20
2018/0328212 A1 * 11/2018 Subramaniyan ..... F01D 5/20
2020/0208532 A1 * 7/2020 Reynolds ..... F04D 29/526
2020/0386111 A1 * 12/2020 Reynolds ..... F01D 9/04
2021/0054761 A1 * 2/2021 Reynolds ..... F04D 29/685
2023/0151825 A1 5/2023 Shi
2024/0159247 A1 5/2024 Joly

* cited by examiner

COMPRESSOR SHROUD WITH SWEPT GROOVES

CROSS-REFERENCE TO RELATED APPLICATIONS

The present application is a continuation of U.S. patent application Ser. No. 17/528,323 filed on Nov. 17, 2021, the entire content of which is incorporated herein by reference.

TECHNICAL FIELD

The disclosure relates generally to aircraft engines and, more particularly, to compressors for such engines.

BACKGROUND

Compressor stall margin is one of many aspects that may affect the overall performance of aircraft engines. While compressor shrouds or casings may have various configurations in order to enhance rotor stall margin, such as surface treatment and/or structural modifications provided on the surface of the shroud, minimizing performance loss in this regard remains desirable.

SUMMARY

There is accordingly provided a compressor for an aircraft engine, comprising: a rotor having a plurality of blades mounted for rotation about a central axis, the plurality of blades having blade tips extending between leading and trailing edges; and a shroud surrounding the rotor and having an inner surface surrounding the blade tips, a plurality of grooves defined in said inner surface of the shroud adjacent said blade tips, the plurality of grooves extending circumferentially about the shroud and extending radially from groove inlet openings defined in the inner surface to closed end surfaces of the plurality of grooves, the plurality of grooves having sidewalls extending circumferentially about the central axis, the plurality of grooves being axially spaced-apart from each other, the groove inlet opening of the most upstream one of the plurality of grooves having an upstream end disposed upstream of the leading edges of the plurality of blades, the plurality of grooves having a swept angle from the inner surface such that a center of the groove inlet openings is axially offset of a center of a closed-end surface of each of the plurality of grooves, the plurality of grooves spanning an overall axial distance corresponding to 30% or more of a chord length of the plurality of blades, wherein the plurality of grooves have circumferential interruptions defined by a plurality of baffles such that the plurality of grooves extend non-continuously around a shroud circumference.

There is also provided a compressor for an aircraft engine, comprising: a rotor having a plurality of blades mounted for rotation about a central axis, the plurality of blades having blade tips extending between leading and trailing edges; and a shroud surrounding the rotor and having an inner surface surrounding the blade tips, a plurality of grooves defined in said inner surface of the shroud adjacent said blade tips, the plurality of grooves extending circumferentially about the shroud and extending radially from groove inlet openings defined in the inner surface to closed end surfaces of the plurality of grooves, the plurality of grooves having sidewalls extending circumferentially about the central axis, the plurality of grooves being axially spaced-apart from each other, the leading edge of the plurality of blades axially disposed between an upstream end of the groove inlet opening of the most upstream one of the plurality of grooves and a downstream end of the groove inlet opening of the most upstream one of the plurality of grooves, the plurality of grooves having a swept angle from the inner surface such that a center of the groove inlet openings is axially offset of a center of a closed-end surface of each of the plurality of grooves, wherein the plurality of grooves have circumferential interruptions defined by a plurality of baffles such that the plurality of grooves extend non-continuously around a shroud circumference.

BRIEF DESCRIPTION OF THE DRAWINGS

Reference is now made to the accompanying figures in which.

DETAILED DESCRIPTION

Figure 1:
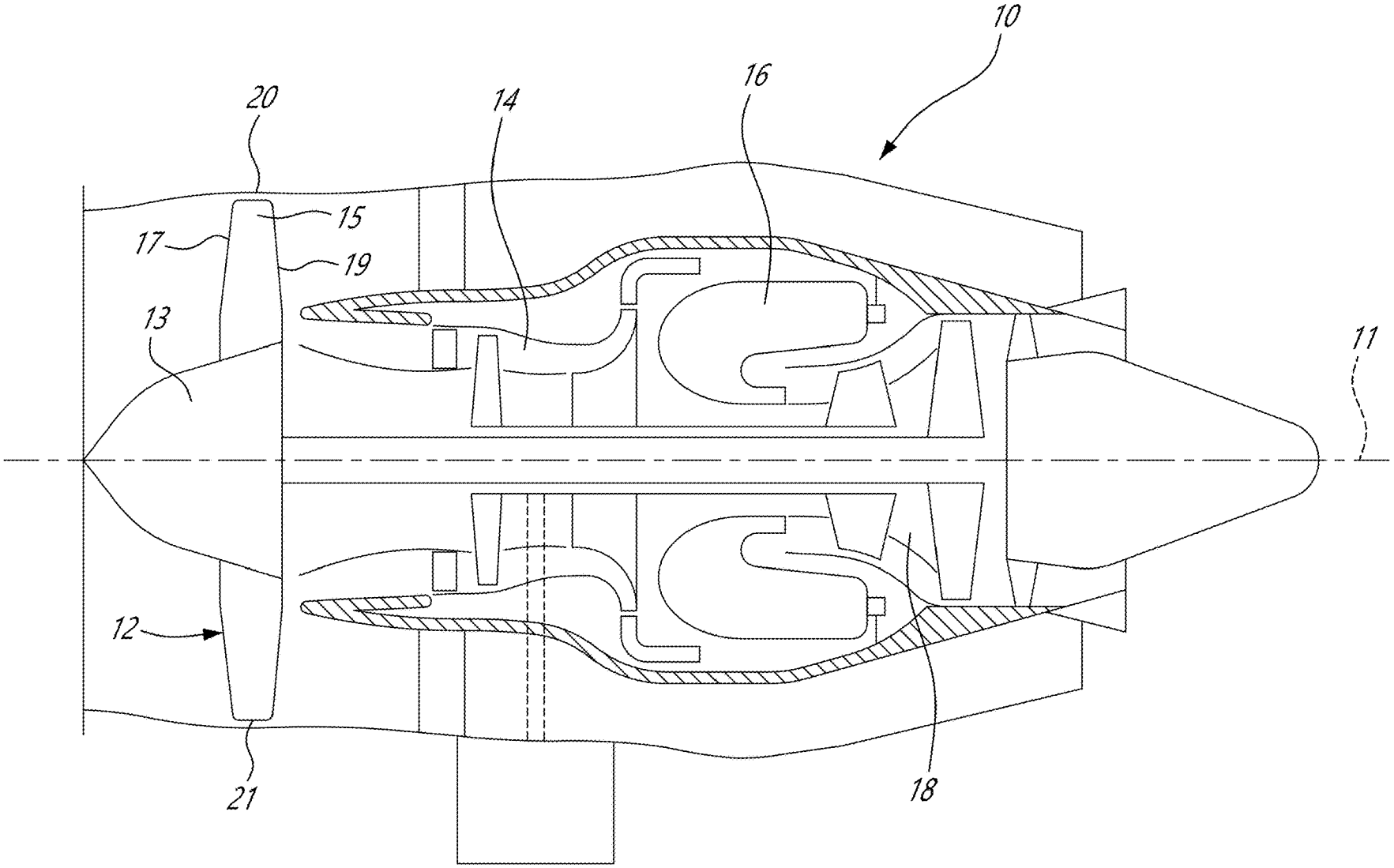
FIG. 1 is a schematic cross sectional view of a gas turbine engine.

FIG. 1 illustrates a turbofan gas turbine engine 10 of a type preferably provided for use in subsonic flight, generally comprising in serial flow communication a transonic fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
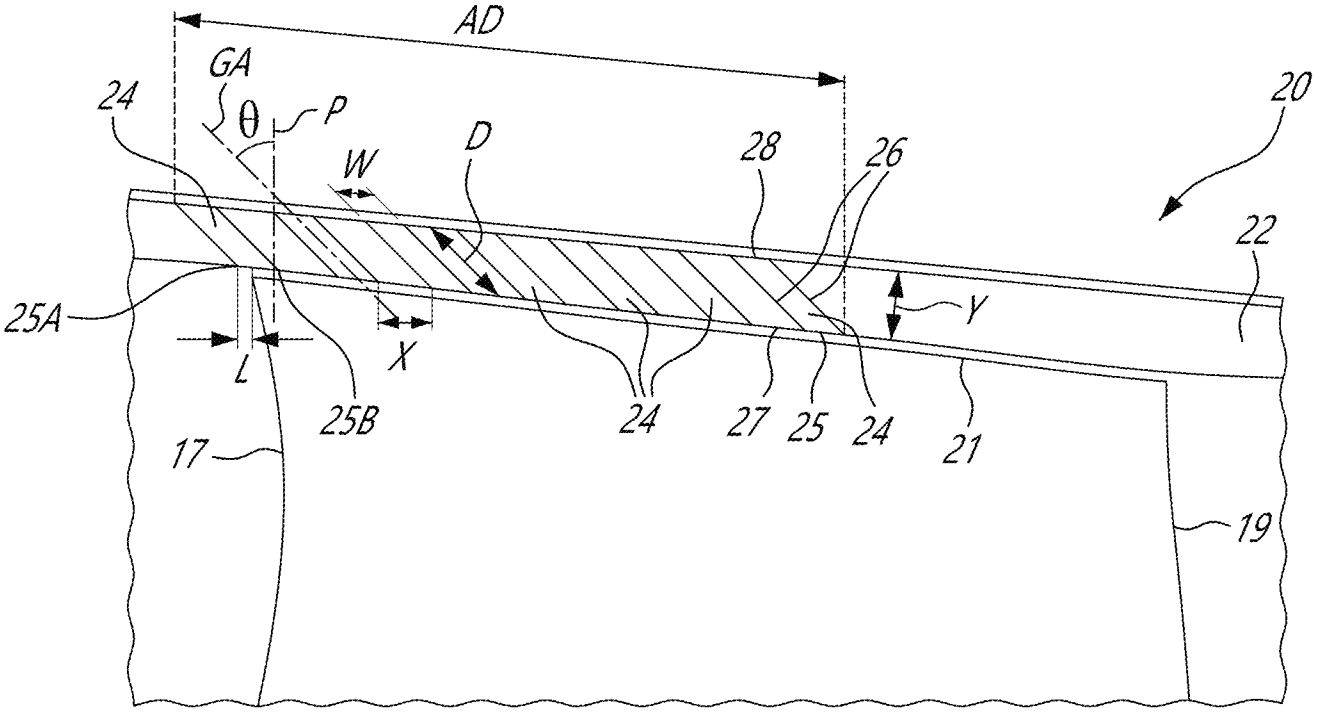
FIG. 2 is a schematic cross-sectional view of an exemplary part of the compressor rotor casing of the engine shown in FIG. 1.

The fan 12, also referred to as a low compressor, comprises a rotor 13 mounted for rotation about the engine central axis 11. The rotor 13 is provided with a plurality of radially extending blades 15. Each blade 15 has a leading edge 17 and a trailing edge 19 extending radially outwardly from the rotor hub to a tip 21. The rotor 13 is surrounded by a casing 20 including a stationary annular shroud disposed adjacent the tips 21 of the blades 15 and defining an outer boundary for the main flow path. As shown in FIG. 2, the casing inner surface is lined with a layer of non-abradable material 22. The layer of non-abradable material 22 may thus be considered as part of the casing inner surface, forming part of the hard shroud wall. In other cases, an abradable material that may detach or break from the casing 20 without causing damages, may be used. The radial distance or gap between the tip 21 of the blades 15 and the adjacent inner surface of the casing 20 is defined as the rotor tip clearance. Each rotor is designed with a nominal rotor tip clearance to prevent or limit interference between the tip 21 of the blades 15 and the casing 20, which may occur due to rotor imbalance.

Referring to FIG. 2, it can be seen that a surface treatment is applied to the low pressure compressor or fan casing 20, though such surface treatment may be applied to a high pressure compressor. As will be seen hereinafter, the surface treatment allows stall margin to be increased and/or tip clearance vortex flow to be weakened and may help to direct the vortex flow in the main flow stream direction. The rotor casing treatment comprises a series of regularly axially spaced-apart circumferential grooves 24 defined in the non-abradable region of the casing inner surface (region of the casing 20 having the layer of non-abradable material 22) axially aligned with the tips 21 of the blades 15. Having regularly axially spaced-apart grooves 24, as opposed to irregularly spaced-apart grooves may facilitate manufacturing and/or parametric design of the engine 10 and/or the surface treatment. In other cases, the grooves 24 may be irregularly or non-uniformly spaced apart in an axial direction along the casing inner surface, as will be discussed in further detail below.

Figure 3:
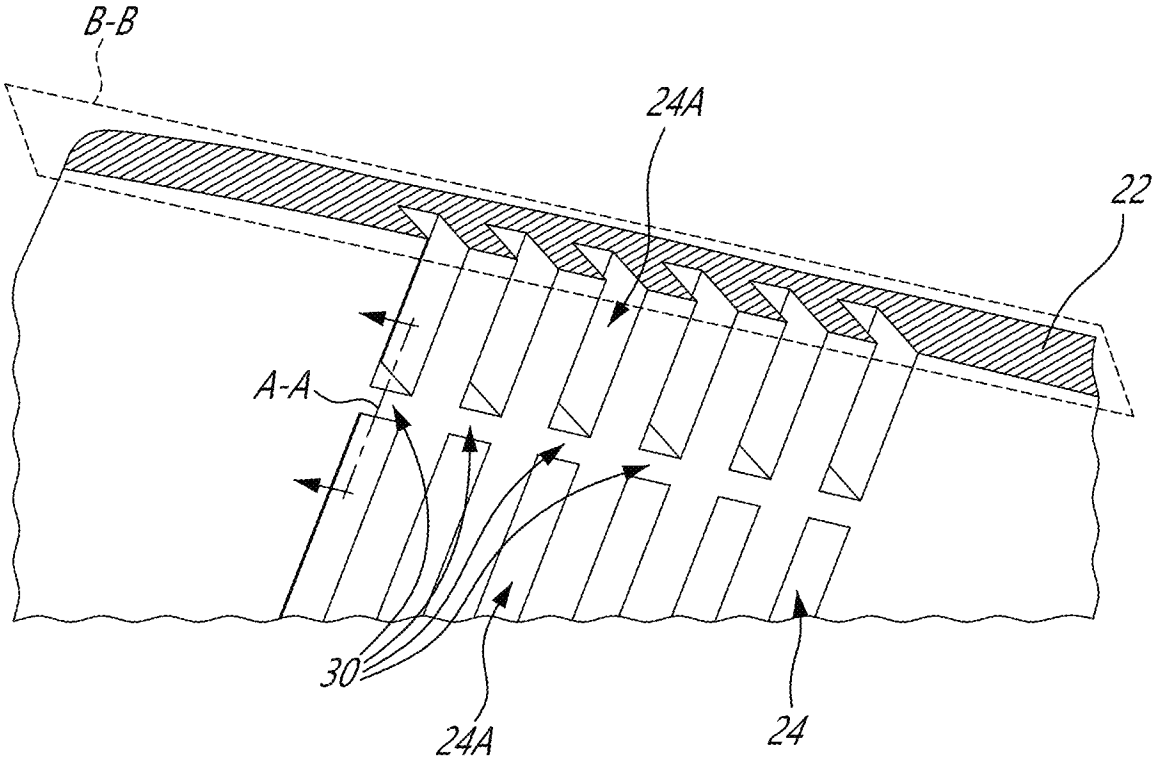
FIG. 3 is an enlarged perspective view of an exemplary part of the compressor rotor casing of FIGS. 1-2, defining a cross-section A-A and a cross-section B-B.

As shown in FIG. 3, the grooves 24 do not extend continuously around 360 degrees. Stated differently, each groove 24 is intersected or interrupted over the circumference of the casing 20. In other words, the grooves 24 have circumferential interruptions such that the grooves 24 extend non-continuously around a shroud circumference. In the depicted embodiment, the circumferential interruptions are defined by a plurality of baffles 30. In other words, each groove 24 comprises a plurality of segments 24A extending circumferentially and separated from an adjacent one of the segments 24A by one of the baffles 30. Although not "continuous" along the full circumference of the casing inner surface, each interrupted groove will be referred to as one groove 24 that comprises a plurality of groove segments 24A, for simplicity.

In the illustrated example, six shallow circumferentially extending grooves 24 are embedded in the non-abradable layer 22 of the rotor shroud around the blades 15. However, it is understood that the series of grooves 24 could be composed of more or less than six grooves 24. For instance, the rotor casing treatment could comprise from 2 to 15 grooves depending on the rotor configuration. The grooves 24 may also be irregularly or non-uniformly axially spaced-apart in other embodiments.

Returning to FIG. 2, in the depicted embodiment, each groove 24 is defined by a pair of axially opposed sidewalls 26, in this embodiment substantially flat, extending forwardly (i.e. towards the front of the engine) from a groove opening (or groove inlet) 25 defined in the shroud surface 27 to a closed-end surface 28. The closed-end surface 28 may be flat, rounded or semi-circular in various embodiments, as will be discussed in further detail below. In the depicted embodiment, opposed sidewalls 26 of adjacent grooves 24 intersect at the opening (or "inlet") 25 with the shroud surface 27, corresponding to a portion of the casing inner surface between adjacent grooves 24, forming a sharp edge. Such edge may be rounded up in other embodiments. Illustratively, each opening 25 includes an upstream end 25A and a downstream end 25B relative to the main flow through the compressor rotor.

As shown in FIG. 2, each groove 24 has a depth D and a width W. The grooves 24 are spaced apart from one another by a spacing X taken axially along the shroud inner surface 27 (distance between the opening of adjacent grooves 24). Such spacing may be equal between each pair of axially adjacent grooves 24. In other cases, the spacing X between a first pair of axially adjacent grooves 24 may be different, i.e. greater or lesser in magnitude, than the spacing X between another pair of axially adjacent grooves 24. Each groove 24 has a depth projection Y normal to the casing inner surface.

As depicted in FIG. 2, the groove inlet opening 25 of the first or upstream groove 24 is axially located upstream of the leading edge 17 of the blades 15. More particularly, the upstream end 25A of the groove inlet opening 25 of the first or upstream groove 24 is axially located upstream of the leading edge 17 of the blades 15 relative to the main flow through the compressor rotor. The upstream end 25A is axially spaced from the leading edge 17 by a distance L corresponding to, for instance, 0% to 10% of the chord length of the blades 15. Other distances may be contemplated as well. In the shown embodiment, although not necessarily the case in all embodiments, the leading edge 17 of the blades 15 is axially disposed between the upstream end 25A and the downstream end 25B of the groove inlet opening 25 of the first or upstream groove 24. Other arrangements may be contemplated as well, for instance both the upstream end 25A and the downstream end 25B of the groove inlet opening 25 of the first or upstream groove 24 being axially disposed upstream of the leading edge 17. In the depicted embodiment, the last or downstream groove 24 is positioned upstream of the blade trailing edges 19. The grooves 24 may occupy an axial distance AD spanning from the first or upstream groove to the last or downstream groove corresponding to 30% or more of the chord length of the blades 15. Illustratively, such axial distance AD may be taken from the upstream-most portion of the closed-end surface 28 of the first or upstream groove 24 to the downstream end 25B of the last or downstream groove 24. Other reference points for axial distance AD may be contemplated as well. Having the distance L and axial distance AD within these ranges may optimize their effect on the flow vortex.

In the shown case, the grooves 24 are forwardly swept (i.e. swept towards a front of the engine, which may also be upstream relative to the main gas flow through the compressor rotor) at an angle θ. In other words, when viewed axially along the tip 21 of a blade 15 from its leading edge 17 to its trailing edge 19, such as in FIGS. 2 and 4, the closed-end surface 28 of each of the grooves 24 is located upstream of the opening 25 of the corresponding groove 24. Alternately defined, the grooves 24 are inclined such that a center of their inlet openings 25 is located axially rearward of a center of their closed-end surfaces 28 with respect to the orientation of the grooves 24 of the casing 20 in the engine 10. The angle θ is taken between an axis P normal to the casing inner surface 27 and a central axis GA extending longitudinally through a center of the grooves 24. Angle θ may be referred to as the groove swept angle, or groove sweep angle, and is more than 0° and less than 75°. In an embodiment, the angle θ is at least 10° but no more than 75°. Due to the groove swept angle within this range, the swept angled grooves 24 may contribute to minimizing total pressure loss by having the flow exiting from the grooves 24 with a sufficient main flow stream direction component, and/or may allow maximizing an internal volume of the grooves 24 although the layer of non-abradable material 22 of the rotor casing may be thin, for maximizing compactness of the rotor casing 20 (to reduce weight and/or size of the rotor casing 20). In other embodiments, the grooves 24 may be rearwardly swept (i.e. swept towards a rear of the engine, which may also be downstream relative to the main gas flow through the compressor rotor) at an angle θ. In such cases, the groove swept angle, or groove sweep angle, may be less than 0° and more than −75° (i.e. a maximum angle of 75° in a rearward direction). In the depicted embodiment, the grooves are all angled identically, but one or more of the grooves 24 may have a different angle θ than other ones or more of the grooves 24 in other embodiments.

In one embodiment, the width W of the grooves 24 is between about 1% to about 15% of the chord length of the blades 15. The spacing X may have any suitable value, for instance respecting an aspect ratio X/W is from about 0.1 to about 5. Other spacing X between grooves 24 may be contemplated, for instance irregular or uneven distributions. In one particular embodiment, the ratio Y/W ranges from about 0.5 to 10. In most cases, larger ratios may be better to trap the tip vortex, though manufacturing may limit the possibilities to have a greater ratio (e.g. a ratio greater or much greater than 10).

While in some embodiments the grooves 24 may all have a same geometry, one or more of the grooves may have a respective geometry that may differ in one or more dimensions, in some cases.

Figure 4:
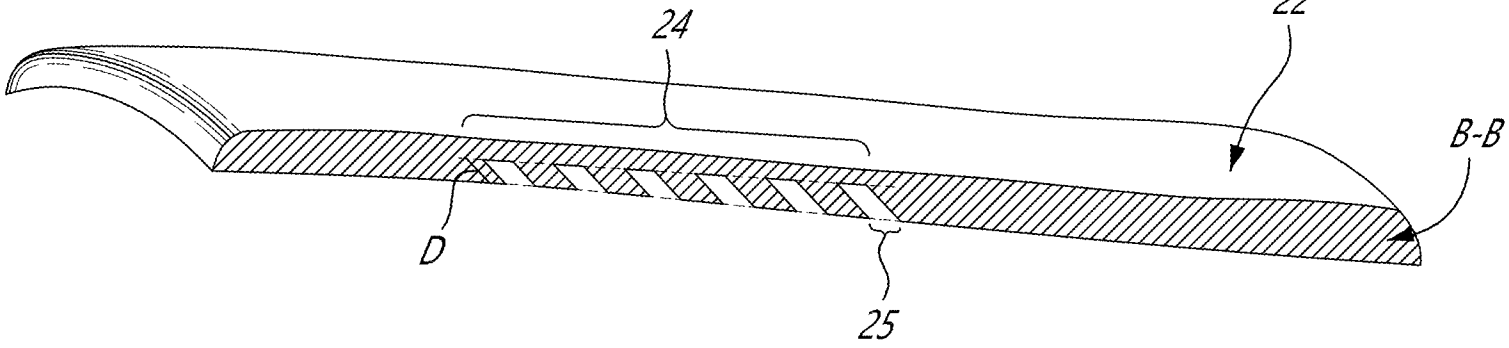
FIG. 4 is another perspective view of the exemplary part of FIG. 3, showing the cross-section B-B in a different angle.

As shown in FIGS. 2 and 4, the respective depths D of the grooves 24 may vary from the first (most upstream groove 24) to the last, more particularly, in this case the respective depths D of the grooves 24 increase from the first to the last groove 24, although they may all have an equal depth D in other embodiments. Depending on the embodiments, the respective depths D of the grooves 24 may substantially correspond to the thickness of the layer of non-abradable material 22 at the local areas where they are defined. Stated differently, the depth projection Y of the grooves 24 may substantially correspond to the thickness of the non-abradable material 22. In other cases, the depths of the grooves 24 may increase or decrease at various rates, or remain constant, from the first to the last groove 24, as will be discussed in further detail below.

Now referring to FIG. 3, the arrays of baffles 30 in the grooves 24 may be angularly aligned with respect to each other. However, the baffles 30 could as well be angularly staggered in the different grooves 24. In addition, the number of baffles in the grooves 24 does not have to be the same. In an embodiment, the number of baffles 30 in each groove 24 is greater than the number of rotor blades 15 but less than 5 times of the latter. In a particular embodiment, the number of baffles 30 in each groove 24 is between 2 and 5 times the number of rotor blades 15. In another particular embodiment, there are two times more baffles 30 per groove 24 than rotor blades 15. Other ratios of baffles 30 per groove 24 may be contemplated as well. Having a greater number of baffles 30 per groove 24 may impede the effects of the casing treatment.

Figure 3A:
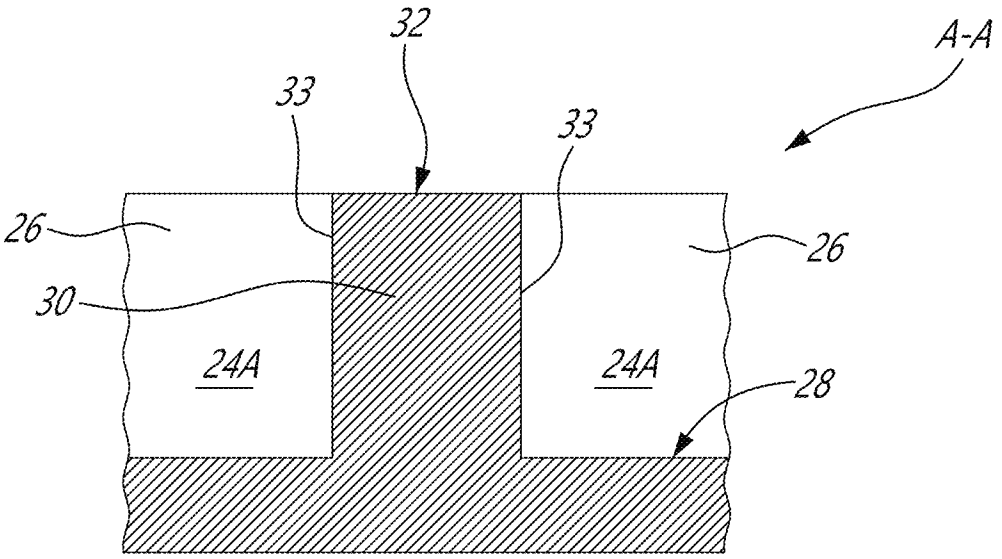
FIG. 3A is a schematic cross-sectional view taken through A-A in FIG. 3.

As shown in FIG. 3A, the baffles 30 are provided in the form of projections from the closed-end surface 28 of the grooves 24 to the inlet opening 25 thereof. That is, the baffles 30 protrude from the closed-end surface 28 over a distance corresponding to the full depth D of the groove 24 in which the baffles 30 are located. The baffles 30 do not necessarily have to be the same shape. The baffles 30 may be integrally machined, moulded or otherwise formed on the closed-end surface 28 of the grooves 24. For instance, cutting tools, such as conventional wood ruff cutters, could be used for machining the grooves 24 and the baffles 30 in the non-abradable layer 22. In this way, the baffles 30 can be formed in the grooves 24 in a cost effective manner. The reparability of the casing 20 may be good since the grooves 24 and the baffles 30 are machined in non-abradable material.

The depicted baffles 30 extend the full width W of the grooves 24 between the groove sidewalls 26 (see FIG. 3). As shown in FIG. 3, each baffle 30 has a substantially flat surface 32 extending in the same plane as the shroud inner surface 27. In other words, the flat surface 32 of the baffles 30 form a continuous surface with adjacent portions of the shroud inner surface. Forming such continuous surface with adjacent portions of the shroud inner surface may contribute to optimizing the effects of the casing treatment herein described. The flat surface 32 may have other shapes, such as concave or other non-flat shape in other embodiments.

As shown in FIG. 3A, the baffles 30 extends along the full depth D of the grooves 24. This may maximize the break of the swirl component (circumferential component) of the main flow stream at the tip of the blades 15 (or simply tip vortex). In the depicted embodiment, the baffles 30 have two opposed walls 33 spaced apart circumferentially from each other and defining respective ends of the baffles 30 (i.e. ends that are spaced apart in the circumferential direction of the grooves 24). In the depicted embodiment, the two opposed walls 33 merge with the flat surface 32 to form a sharp edge at their junction, though rounded edges may be contemplated in other embodiments. The grooves closed-end surface 28 and the baffles 30 form an intersected radially inwardly facing surface at the closed end of each groove 24, such that the radially inwardly facing surface is discontinuous along the length (defined along the circumference of the casing inner surface) of each groove 24. Although such circumferentially intersected grooves 24 may generate flow turbulence due to the baffles 30 opposing the circumferential component of the tip flow vortex entering and exiting the grooves 24, such turbulence resulting from the presence of the baffles 30 may be more beneficial to the performance of the engine 10 than if the baffles 30 were omitted entirely, where the circumferential component of the main flow stream (or tip vortex), would not be suitably controlled. The presence of groove interruptions, such as the baffles 30 herein described, may enhance the momentum exchanges between main flow and tip clearance flow, hence enhance the effect of the casing treatment.

Figure 3B:
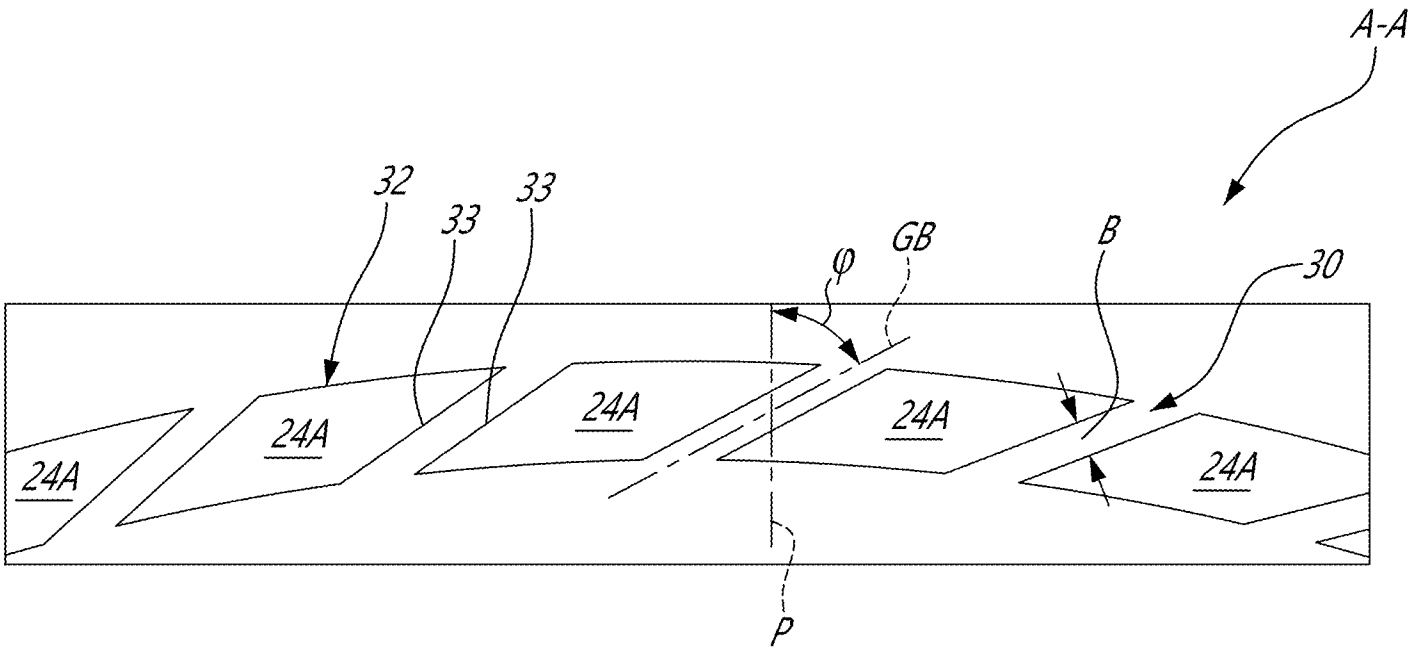
FIG. 3B is a schematic cross-sectional view taken through A-A of an alternate compressor rotor casing.

Referring to FIG. 3B, another baffle configuration is shown. In the depicted embodiment, the baffles 30 another embodiment the baffles lean with an angle ϕ relative to the axis P normal to the casing inner surface 27. In some embodiments, the angle ϕ may vary from −75° to +75°, i.e. into or away from a rotational direction of the blades 15. The shape of the baffles 30 may vary. For instance, the edges of the baffles may be sharp or rounded. A width B of the baffles 30 may be constant along both radial and axial directions, for instance a tenth of the groove width W. In other cases, the baffle width B may vary in one or both of the radial and axial directions. The circumferential distribution of baffles may be uniform or uneven, or may assume other irregular patterns as well.

Figure 5:
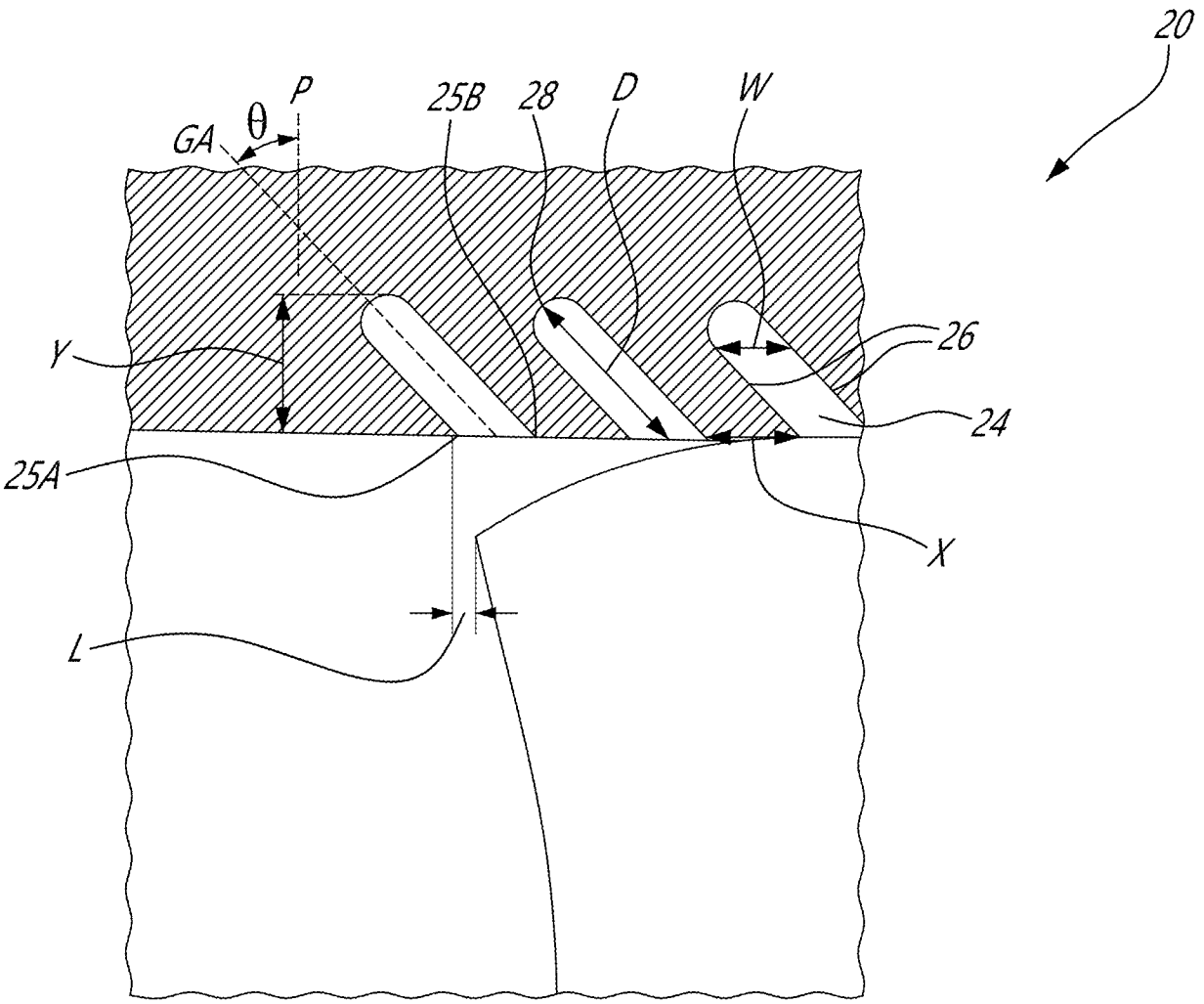
FIG. 5 is a schematic cross-sectional view of another exemplary part of a compressor rotor casing of the engine shown in FIG. 1.

Referring to FIG. 5, another exemplary fan casing 20 is shown, with like reference numerals referring to like elements. The various features discussed in relation to the fan casing depicted in FIG. 2 may be understood to be applicable to the fan casing depicted in FIG. 5 as well, for instance the upstream end 25A of the groove inlet opening 25 of the first or upstream groove 24 being axially located upstream of the leading edge 17 of the blades 15 relative to the main flow through the compressor rotor. Of note, in the fan casing 20 shown in FIG. 5, the closed-end surfaces 28 of the grooves 24 are rounded or semi-circular. Other shapes for the closed-end surfaces 28 may be contemplated as well. In addition, in the embodiment shown in FIG. 5, the depths D of each is the grooves 24 is constant from the most upstream groove 24 to the most downstream groove 24. Other depths D, for instance increasing or decreasing depths along the downstream direction, may be contemplated as well. In the depicted embodiment, the grooves 24 each have a forward swept angle θ of 45° relative to axis P normal to the casing inner surface 27. Other angles, including rearward swept angles, may be contemplated as well.

Figure 6:
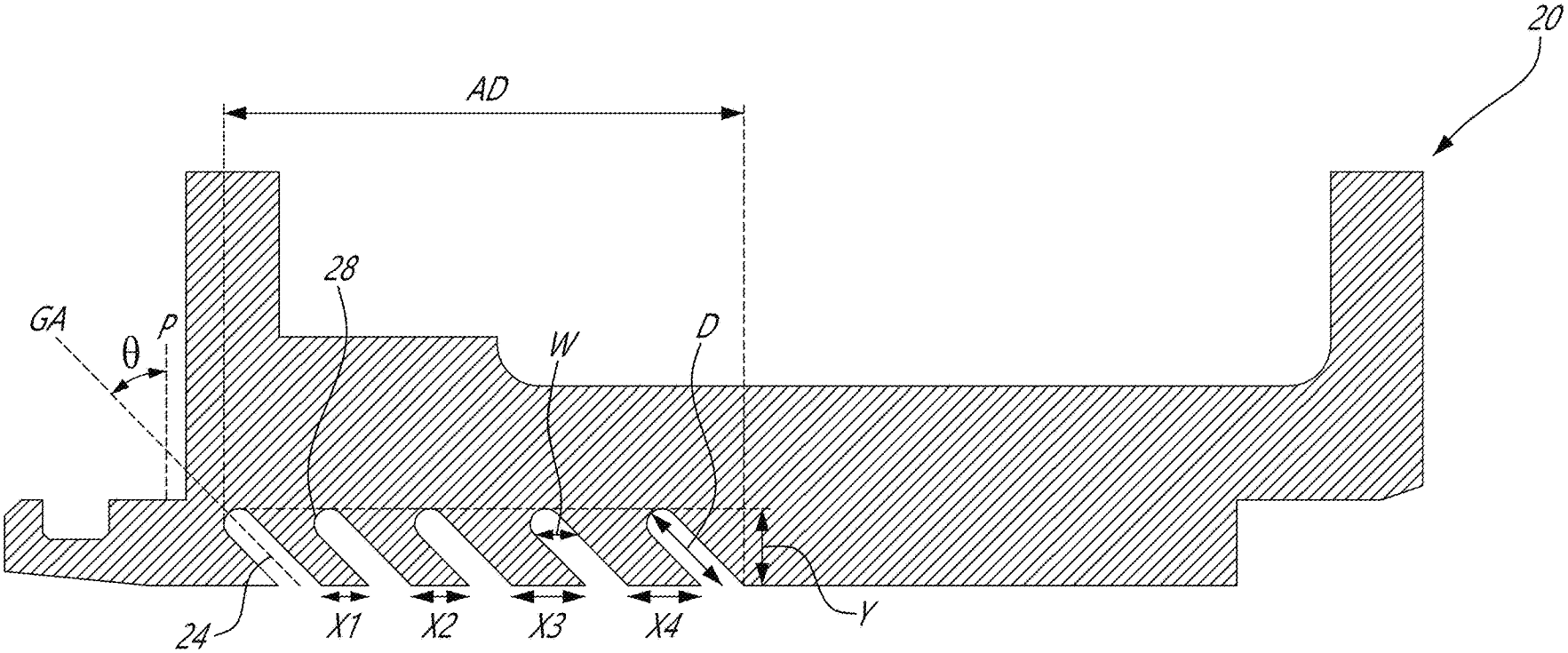
FIG. 6 is a side view of an exemplary part of the compressor rotor casing of FIG. 5.

Referring to FIG. 6, the depicted casing 20 includes unevenly-spaced grooved 24. In other words, spacing X1 between a first pair of grooves 24 is different than spacing X2, X3, X4, etc. In the depicted case, the ratio between spacing X (X1, X2, X3, X4) and the groove width W (X/W) may vary between 0.5 and 5. In other embodiments, the ratio (X/W) may vary between 3 and 3.6. Other ratios may be contemplated as well. As discuss above, and in the depicted case, the groove depth D may be consistent for each groove 24. In the depicted case, each groove 24 includes a rounded or semi-circular closed-end surface 28.

Figure 7C:
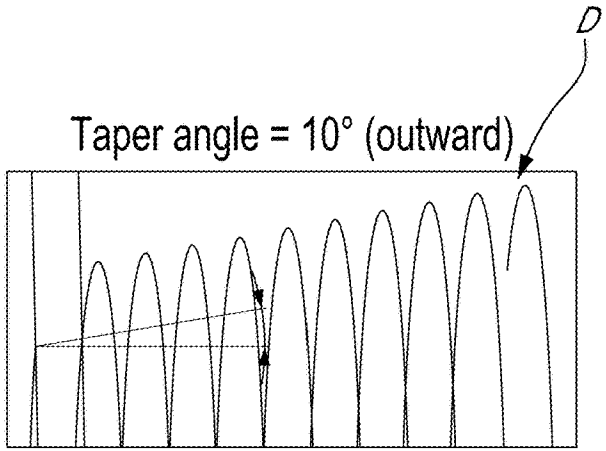
FIG. 7A-7C are graphical representations of various groove taper angles in a compressor rotor casing.
Figure 7B:
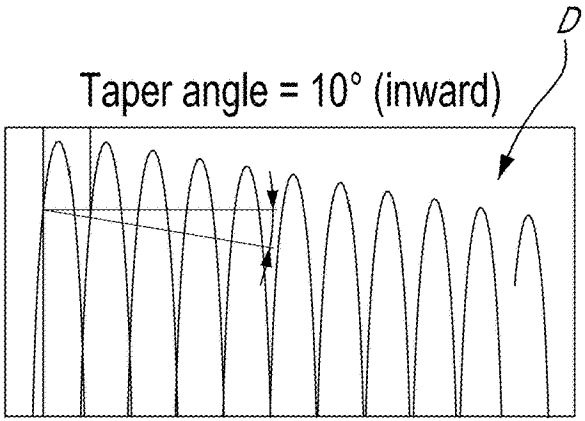
Figure 7A:
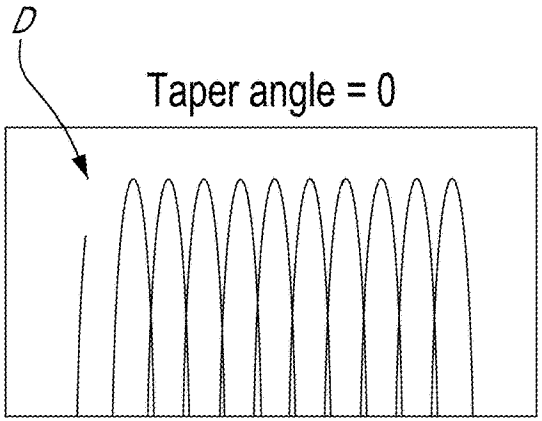

Referring to FIGS. 7A-7C, in various embodiments, the taper angle of the grooves 24, i.e. the variation in radius from one groove 24 to the next, can either remain constant (ex: FIG. 7A), decrease (Ex: FIG. 7B) or increase (EX: FIG. 7C) from an upstream end to a downstream end of the casing 20. In FIG. 7A, the taper angle is shown to remain constant, i.e. a taper angle of 0° between grooves 24. In FIG. 7B, an exemplary inward or decreasing taper angle of 10°, is shown. In FIG. 7C, an exemplary outward or increasing taper angle of 10° is shown. Other inward or outward taper angles may be contemplated. For instance, in various cases the taper angle may vary from 20° inward to 20° outward.

Figure 8B:
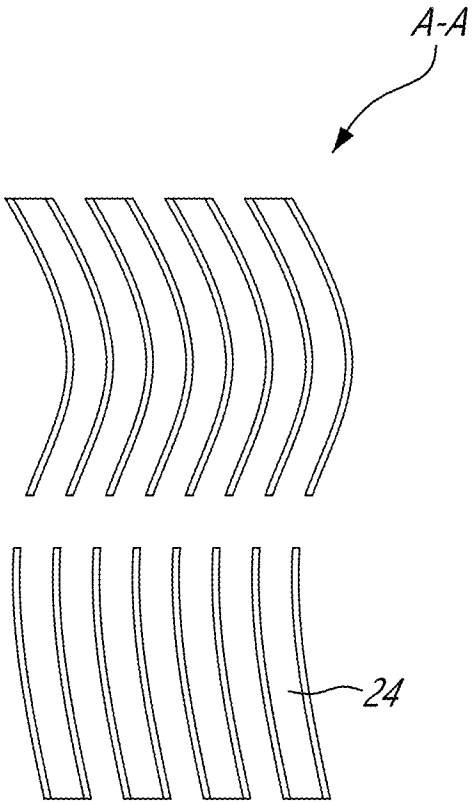
FIGS. 8A-8B are schematic cross-sectional views taken through A-A in FIG. 3 of various groove and baffle configuration options.
Figure 8A:
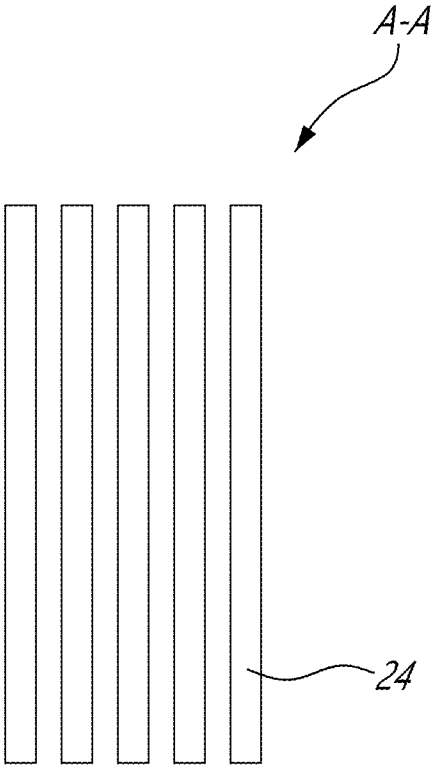

Referring to FIGS. 8A-8B, the grooves 24 may take on various shapes or patterns when viewed from cross-section A-A. For instance, the grooves 24 depicted in FIG. 7A are shown to have a linearly-circumferential shape, while the grooves 24 depicted in FIG. 7B are shown to have non-linear or curved shape. Other groove patterns or shapes, or instance for instance helically-threaded grooves with baffles, may be contemplated as well.

In the present disclosure, when a specific numerical value is provided (e.g. as a maximum, minimum or range of values), it is to be understood that this value or these ranges of values may be varied, for example due to applicable manufacturing tolerances, material selection, etc. As such, any maximum value, minimum value and/or ranges of values provided herein (such as, for example only, the plurality of grooves spanning an overall axial distance corresponding to 30% or more of a chord length of the plurality of blades), include(s) all values falling within the applicable manufacturing tolerances. Accordingly, in certain instances, these values may be varied by ±5%. In other implementations, these values may vary by as much as ±10%. A person of ordinary skill in the art will understand that such variances in the values provided herein may be possible without departing from the intended scope of the present disclosure, and will appreciate for example that the values may be influenced by the particular manufacturing methods and materials used to implement the claimed technology.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A compressor for an aircraft engine, comprising:

a rotor having a plurality of blades mounted for rotation about a central axis, the plurality of blades having blade tips extending between leading and trailing edges; and a shroud surrounding the rotor and having an inner surface surrounding the blade tips, a plurality of grooves defined in said inner surface of the shroud adjacent said blade tips, the plurality of grooves being annular and extending circumferentially about the shroud, each of the plurality of grooves extending radially outward from groove inlet openings defined in the inner surface to closed end surfaces of the plurality of grooves, the plurality of grooves being axially spaced-apart from each other, the groove inlet opening of the most upstream one of the plurality of grooves having an upstream end disposed upstream of the leading edges of the plurality of blades and a downstream end disposed downstream of the leading edges of the plurality of blades, the plurality of grooves spanning an overall axial distance corresponding to 30% or more of a chord length of the plurality of blades, wherein the plurality of grooves have circumferential interruptions defined by a plurality of baffles within the plurality of grooves such that each of the plurality of grooves extends circumferentially non-continuously around a shroud circumference;

wherein the plurality of baffles within the plurality of grooves are circumferentially angled in a circumferential direction relative to an axis normal to the inner surface of the shroud, such that a center of the plurality of baffles at the groove inlet openings is circumferentially offset form the center of the plurality of baffles at the closed-end surface of the plurality of grooves; and wherein each of the plurality of grooves is inclined in a fore-aft direction relative to the central axis to define a swept angle from the inner surface such that a center of the groove inlet openings is axially offset of a center of a closed-end surface of each of the plurality of grooves.

2. The compressor as defined in claim 1, wherein the upstream end of the groove inlet opening of the most upstream one of the plurality of grooves is axially spaced from the leading edge of the plurality of blades by a distance corresponding to at most 10% of the chord length of the plurality of blades.

3. The compressor as defined in claim 1, wherein the plurality of baffles are circumferentially spaced apart and project from the closed end surfaces to the groove inlet openings.

4. The compressor as defined in claim 1, wherein a first axial gap is defined between a first pair of adjacent plurality of grooves and a second axial gap is defined between a second pair of adjacent plurality of grooves, the first axial gap having a distance different than a distance of the second axial gap.

5. The compressor as defined in claim 4, wherein a ratio of each axial gap distance between pairs of adjacent plurality of grooves and a width of each of the plurality of grooves ranges between 0.5 and 5.

6. The compressor as defined in claim 1, wherein the plurality of grooves have a forwardly swept angle from the inner surface such that the center of the groove inlet openings is located axially rearward of the center of the closed-end surface of each of the plurality of grooves.

7. The compressor as defined in claim 1, wherein each of the plurality of grooves includes a forward or rearward groove swept angle of more than 0 degrees and less than 75 degrees.

8. The compressor as defined in claim 1, wherein each of the plurality of grooves is angled in the circumferential direction in a clockwise or counterclockwise direction at an angle of up to 75 degrees relative to the axis normal to the inner surface of the shroud.

9. The compressor as defined in claim 1, wherein the plurality of grooves each have a radius that increases or decreases in magnitude from an upstream end of the shroud to a downstream end of the shroud.

10. The compressor as defined in claim 9, wherein the radius of each of the plurality of grooves increases or decreases at a taper angle of 20 degrees from the upstream end of the shroud to the downstream end of the shroud.

11. The compressor as defined in claim 1, wherein the closed end surfaces of the plurality of grooves are rounded closed end surfaces.

12. The compressor as defined in claim 1, wherein the compressor includes a layer of non-abradable material lined on the inner surface of the shroud about the blade tips, the layer of non-abradable material embedding the plurality of grooves and baffles.

13. The compressor as defined in claim 1, wherein the grooves have a width between about 1% to about 15% of the chord length of the blades.

14. The compressor as defined in claim 1, wherein depths of the plurality of grooves are constant from the most upstream one of the plurality of grooves to the most downstream one of the plurality of grooves.

15. A compressor for an aircraft engine, comprising:

a rotor having a plurality of blades mounted for rotation about a central axis, the plurality of blades having blade tips extending between leading and trailing edges; and a shroud surrounding the rotor and having an inner surface surrounding the blade tips, a plurality of grooves defined in said inner surface of the shroud adjacent said blade tips, the plurality of grooves extending circumferentially about the shroud and extending radially from groove inlet openings defined in the inner surface to closed end surfaces of the plurality of grooves, the plurality of grooves having sidewalls extending circumferentially about the central axis, the plurality of grooves being axially spaced-apart from each other, the leading edge of the plurality of blades axially disposed between an upstream end of the groove inlet opening of the most upstream one of the plurality of grooves and a downstream end of the groove inlet opening of the most upstream one of the plurality of grooves, the plurality of grooves inclined in a fore-aft direction relative to the central axis to define a swept angle from the inner surface such that a center of the groove inlet openings is axially offset of a center of a closed-end surface of each of the plurality of grooves, the plurality of grooves angled in a circumferential direction relative to an axis normal to the inner surface such that the center of each of the groove inlet openings is circumferentially offset of the center of the closed-end surface of each of the plurality of grooves, wherein the plurality of grooves have circumferential interruptions defined by a plurality of baffles such that the plurality of grooves extend non-continuously around a shroud circumference.

16. The compressor as defined in claim 15, wherein the plurality of grooves span an overall axial distance corresponding to 30% or more of a chord length of the plurality of blades.

17. The compressor as defined in claim 15, wherein the upstream end of the groove inlet opening of the most upstream one of the plurality of grooves is axially spaced from the leading edge of the plurality of blades by a distance corresponding to at most 10% of a chord length of the plurality of blades.

18. The compressor as defined in claim 15, wherein a first axial gap is defined between a first pair of adjacent plurality of grooves and a second axial gap is defined between a second pair of adjacent plurality of grooves, the first axial gap having a distance different than a distance of the second axial gap.

19. The compressor as defined in claim 15, wherein depths of the plurality of grooves are constant from the most upstream one of the plurality of grooves to the most downstream one of the plurality of grooves.

20. A shroud treatment embedded in an inner surface of a compressor shroud surrounding a plurality of rotor blades of an aircraft engine having a central axis about which the plurality of rotor blades rotate, comprising:

a plurality of grooves defined in the inner surface of the compressor shroud adjacent blade tips of the plurality of rotor blades, the plurality of grooves extending circumferentially about the shroud and extending radially from groove inlet openings defined in the inner surface to closed end surfaces of the plurality of grooves, the plurality of grooves having sidewalls extending circumferentially about the central axis, the plurality of grooves being axially spaced-apart from each other, the groove inlet opening of the most upstream one of the plurality of grooves having an upstream end disposed upstream of the leading edges of the plurality of rotor blades and a downstream end disposed downstream of the leading edges of the plurality of rotor blades, the plurality of grooves spanning an overall axial distance corresponding to 30% or more of a chord length of the plurality of rotor blades, wherein the plurality of grooves have circumferential interruptions defined by a plurality of baffles such that the plurality of grooves extend non-continuously around a circumference of the compressor shroud;

wherein each of the plurality of grooves is inclined in a fore-aft direction relative to the central axis to define a swept angle from the inner surface such that a center of the groove inlet openings is axially offset of a center of a closed-end surface of each of the plurality of grooves, and each of the plurality of grooves is angled in a circumferential direction relative to a plane normal to the inner surface of the compressor shroud such that the upstream end of each of the plurality of groove inlet openings is circumferentially offset of the downstream end of each of the plurality of groove inlet openings relative to the central axis.

* * * * *